US009844308B2

(12) United States Patent
Thorne et al.

(10) Patent No.: US 9,844,308 B2
(45) Date of Patent: Dec. 19, 2017

(54) SURFACE CLEANING APPARATUS

(71) Applicant: SharkNinja Operating LLC, Newton, MA (US)

(72) Inventors: Jason Thorne, Wellesley Hills, MA (US); Peter Hutchinson, Newton, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 14/247,911

(22) Filed: Apr. 8, 2014

(65) Prior Publication Data

US 2016/0128530 A1 May 12, 2016

(51) Int. Cl.

| | |
|---|---|
| ***A47L 9/16*** | (2006.01) |
| ***A47L 5/36*** | (2006.01) |
| ***A47L 9/12*** | (2006.01) |
| ***A47L 9/22*** | (2006.01) |

(52) U.S. Cl.

CPC ..... *A47L 9/16* (2013.01); *A47L 5/362* (2013.01); *A47L 9/122* (2013.01); *A47L 9/1683* (2013.01); *A47L 9/1691* (2013.01); *A47L 9/22* (2013.01)

(58) Field of Classification Search

CPC ..... A47L 9/1683; A47L 9/1608; A47L 9/122; A47L 5/362; A47L 9/10; A47L 9/12; A47L 9/22; A47L 9/1691; A47L 9/16

See application file for complete search history.

(56) References Cited

U.S. PATENT DOCUMENTS

| | | | | |
|---|---|---|---|---|
| 5,135,552 | A | 8/1992 | Weistra | |
| 6,406,505 | B1 * | 6/2002 | Oh | A47L 5/362 15/353 |
| 7,381,236 | B2 * | 6/2008 | Lee | A47L 9/1608 55/426 |
| 2002/0069476 | A1 | 6/2002 | Yung | |
| 2003/0167590 | A1 * | 9/2003 | Oh | A47L 9/104 15/347 |
| 2006/0037172 | A1 * | 2/2006 | Choi | A47L 9/1683 15/353 |
| 2006/0080947 | A1 | 4/2006 | Lee et al. | |

(Continued)

OTHER PUBLICATIONS

PCT Search Report and Written Opinion received in corresponding PCT Application No. PCT/US15/24782, 11 pgs.

*Primary Examiner* — Robert Scruggs
(74) *Attorney, Agent, or Firm* — Grossman Tucker Perreault & Pfleger, PLLC

(57) ABSTRACT

A surface treatment apparatus may include an air flow path extending from a dirty air inlet to a clean air outlet and a main body. A suction motor may be provided in the air flow path. A cyclone bin assembly may be provided in the air flow path and may be removably mountable to the main body. A pre-motor filter chamber may be provided and may have a rear wall, a sidewall extending and an openable front wall opposite the rear wall and sealingly enclosing the pre-motor filter chamber. The pre-motor filter chamber may be disposed longitudinally between the cyclone bin assembly and the suction motor and the cyclone bin assembly may be positioned in front of at least a portion of the openable front wall of the pre-motor filter chamber. The front wall may be accessible when the cyclone bin assembly is removed from the main body.

16 Claims, 8 Drawing Sheets

(56) References Cited

U.S. PATENT DOCUMENTS

| | | | | |
|---|---|---|---|---|
| 2006/0272299 | A1* | 12/2006 | Choi | A47L 9/122 55/337 |
| 2010/0154367 | A1 | 6/2010 | Luo et al. | |
| 2010/0224073 | A1* | 9/2010 | Oh | A47L 9/1641 96/416 |
| 2010/0251507 | A1 | 10/2010 | Conrad | |
| 2014/0143977 | A1* | 5/2014 | Wofford | A47L 9/122 15/347 |

* cited by examiner

SURFACE CLEANING APPARATUS

FIELD

The disclosure relates to surface cleaning apparatuses, such as vacuum cleaners.

INTRODUCTION

The following is not an admission that anything discussed below is part of the prior art or part of the common general knowledge of a person skilled in the art.

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

It will be appreciated by a person skilled in the art that a surface cleaning apparatus may embody any one or more of the features contained herein and that the features may be used in any particular combination or sub-combination.

In accordance with one broad aspect of the teachings described herein, a surface treatment apparatus may include an air flow path extending from a dirty air inlet to a clean air outlet and a main body movable in a longitudinal direction of travel and having a front end and a rear end spaced behind the front end in the direction of travel. A suction motor may be provided in the air flow path. A cyclone bin assembly may be provided in the air flow path and may be removably mountable to the main body. A pre-motor filter chamber may be provided in the main body. The pre-motor filter chamber may have a rear wall, a sidewall extending from the rear wall and an openable front wall opposite the rear wall and sealingly enclosing the pre-motor filter chamber. When the cyclone bin assembly is mounted on the main body the pre-motor filter chamber may be disposed longitudinally between the cyclone bin assembly and the suction motor and the cyclone bin assembly may be positioned in front of at least a portion of the openable front wall of the pre-motor filter chamber. The front wall may be accessible when the cyclone bin assembly is removed from the main body.

When the cyclone bin assembly is mounted on the main body the cyclone bin assembly may cover the entire front wall.

At least a portion of the front wall may be transparent.

A filter may be positioned in the pre-motor filter chamber and an upstream surface of the filter may face and may be spaced apart from the front wall.

The pre-motor filter chamber may include a chamber air inlet in communication with the cyclone bin assembly and disposed on the sidewall.

The chamber air inlet may include an elongate slit in the sidewall. The filter may have a width in a transverse direction that is generally orthogonal the longitudinal direction and the slit may have a width in the transverse direction that is between about 30% and about 100% of the width of the filter.

The pre-motor filter chamber may include a chamber air outlet disposed on the rear wall and in communication with the suction motor.

The suction motor may extend along a motor axis, and the motor axis may intersect both the front wall and the rear wall.

Optionally, when the cyclone bin assembly is mounted on the main body the motor axis intersects the cyclone bin assembly.

The front wall may include an inner surface and at least one rib projecting from the inner surface. When the front wall is sealingly enclosing the pre-motor filter chamber the at least one rib may bear against a filter positioned in the pre-motor filter chamber.

A bleed valve may have a valve air inlet and a valve air outlet provided in the rear wall and in air flow communication with the pre-motor filter chamber.

The cyclone chamber may have an axial cross-section area and a filter cross-sectional area in an air flow direction may be is equal to or greater than the cyclone chamber cross-sectional area.

The front wall may include a handle portion.

The front wall may sealingly connect to the sidewall via a friction fit and is detachable from the sidewall in the absence of releasing a retaining fastener.

The cyclone bin assembly may include a lower end wall comprising a bin assembly air outlet, an opposing upper end wall and an exterior bin sidewall extending therebetween, and wherein when the cyclone bin assembly is mounted on the main body the front wall abuts a first portion of the bin sidewall.

The cyclone bin assembly may include a bin air inlet disposed in a second portion of the bin sidewall. The second portion of the bin sidewall may be longitudinally opposite the first portion of the bin sidewall.

The main body may include a chassis comprising at least two wheels and a cleaning unit detachably mounted to the chassis. The cleaning unit may include the suction motor, the pre-motor filter chamber and the cyclone bin assembly and may be operable to clean a surface while detached from the chassis.

In accordance with another broad aspect of the teachings described herein, a surface treatment apparatus may include an air flow path extending from a dirty air inlet to a clean air outlet. A main body may be movable in a longitudinal direction of travel and may include a front end and a rear end spaced behind the front end in the direction of travel, and a suction motor provided in the air flow path. A cyclone bin assembly may be provided in the air flow path and may include a lower end wall which has a bin assembly air outlet. The cyclone bin assembly may be removably mountable to the main body. A pre-motor filter chamber may be provided in the main body. The pre-motor filter chamber may have a rear wall, a sidewall extending from the rear wall and an openable front wall opposite the rear wall and sealingly enclosing a pre-motor filter in the pre-motor filter chamber. The main body may have a platform on which the cyclone bin assembly is positioned when mounted to the main body.

The platform may have a main body air inlet connected in airflow communication with the bin assembly air outlet when the cyclone bin assembly is mounted to the main body. The main body may have an airflow path from the main body air inlet to the suction motor. The air flow path may direct air travelling therethrough rearwardly and upwardly so as to reach and pass through the pre-motor filter.

The pre-motor filter chamber may include a chamber air inlet disposed in a lower portion of the pre-motor filter chamber sidewall and positioned below a plane containing the cyclone chamber air outlet.

The pre-motor filter chamber may include a chamber air inlet disposed in a lower portion of the pre-motor filter chamber sidewall and air travelling through the chamber air inlet may travel generally upwardly in a direction that is generally parallel to a plane containing the pre-motor filter chamber front wall and is generally orthogonal to a rotation axis of the suction motor.

DRAWINGS

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
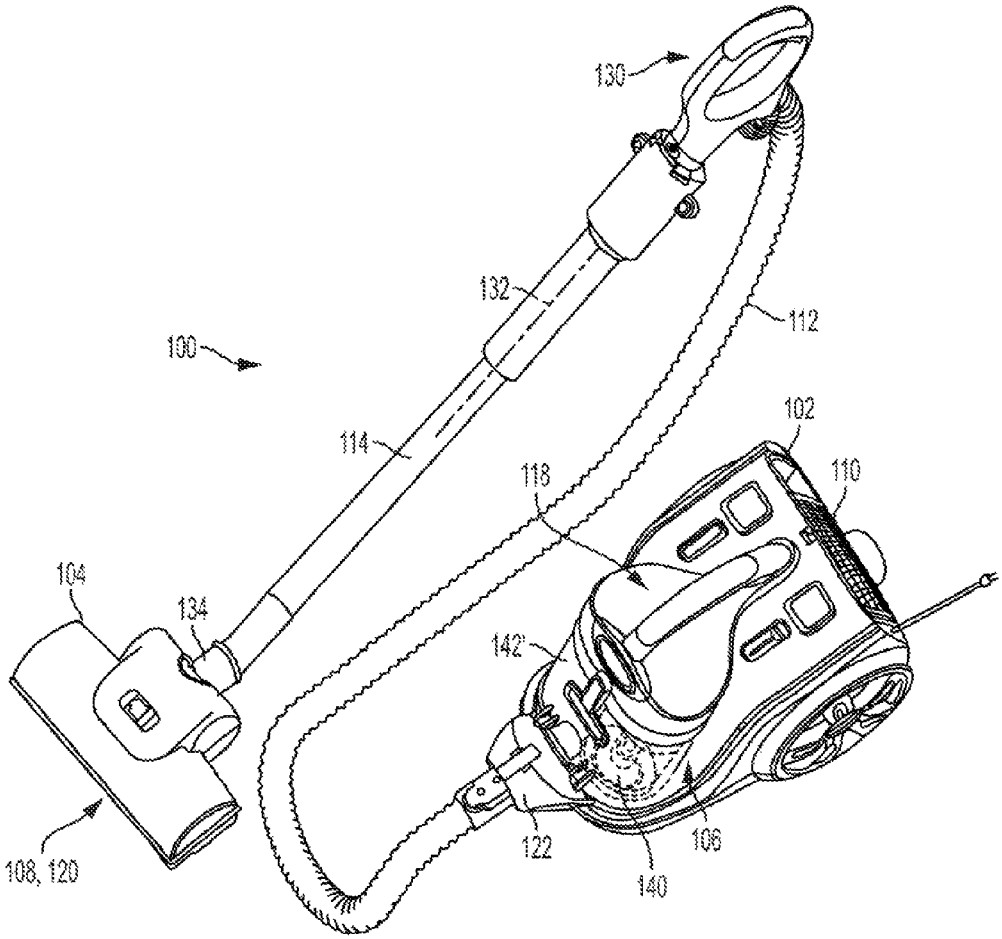
FIG. 1 is a perspective view of an example of a surface cleaning apparatus.

Referring to FIG. 1, an example of a surface cleaning apparatus 100 is shown. In the example shown, the surface cleaning apparatus 100 is a canister-type vacuum cleaner. In alternate embodiments, the surface cleaning apparatus may be another suitable type of surface cleaning apparatus, such as an upright-style vacuum cleaner, and hand vacuum cleaner, a stick vac, a wet-dry type vacuum cleaner, a carpet extractor or the like.

In the illustrated example, the surface cleaning apparatus 100 includes a chassis portion 102 and a surface cleaning head 104. A surface cleaning unit 106 is mounted on the chassis portion 102. The surface cleaning apparatus 100 also has at least one dirty air inlet 108, at least one clean air outlet 110, and an air flow path or passage extending therebetween. In the illustrated example, the air flow path includes a flexible air flow conduit member in the form of a hose 112 and a rigid up flow conduit 114.

At least one suction motor 116 (FIG. 6) and at least one air treatment member are positioned in the air flow path to separate dirt and other debris from the airflow. Preferably, the chassis portion 102 and/or surface cleaning unit 106 include the suction motor, to draw dirty air in through the dirty air inlet, and the air treatment member to remove dirt or debris from the dirty air flow. The air treatment member may be any suitable air treatment member, including, for example, one or more cyclones, filters, and bags. Preferably at least one air treatment member is provided upstream from the suction motor. In the illustrated example the air treatment member is provided in the form of a cyclone bin assembly 118.

In the embodiment shown, the surface cleaning head 104 includes the dirty air inlet in the form of a slot or opening 120 formed in a generally downward facing surface of the surface cleaning head 104. From the dirty air inlet, the air flow path extends through the surface cleaning head 104, and through the up flow conduit 114. In the illustrated example, the surface cleaning unit 106 includes a hose coupling member 122 that has an upstream end 124 (FIGS. 2 and 6) that is connected to the hose 112, and a downstream end 126 (FIG. 6) that is connected to the air treatment member (the cyclone bin assembly in the illustrated example).

Figure 6:
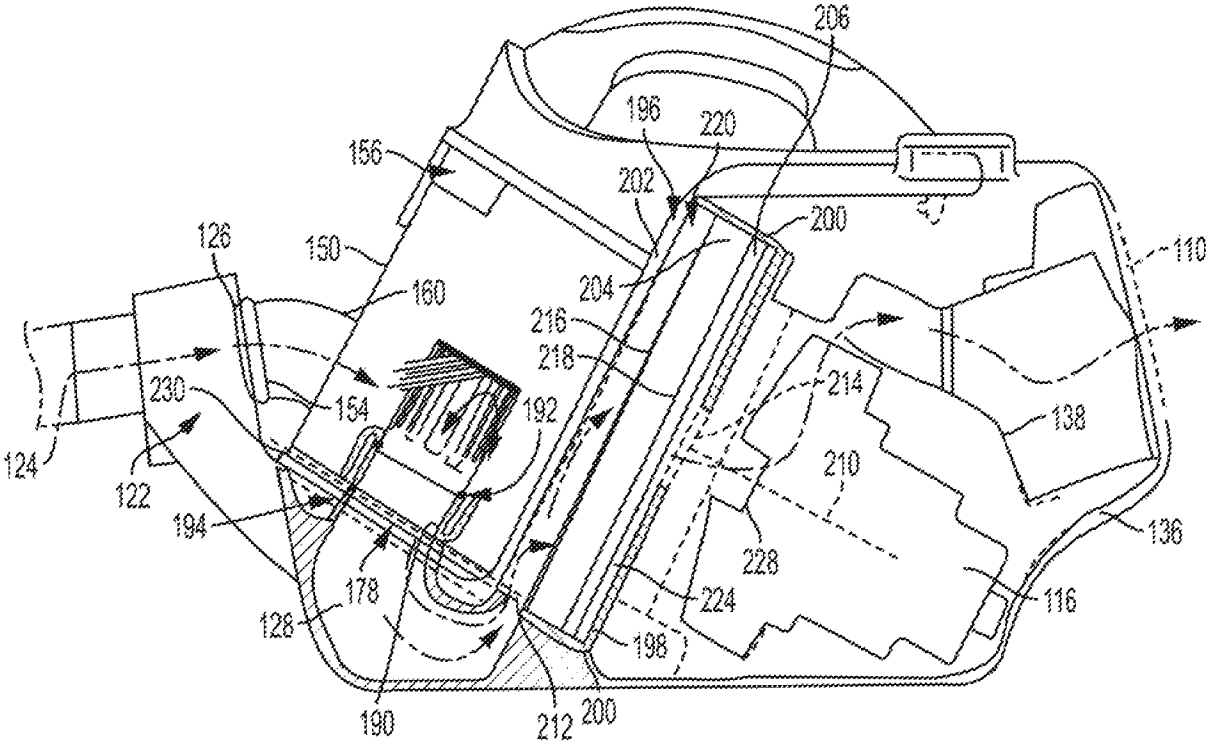
FIG. 6 is a section view of a portion of the surface cleaning apparatus taken along line 6-6 in FIG. 5.

Referring also to FIG. 6, from the air treatment member 118, air flows through an internal air flow conduit 128 in the surface cleaning unit 106 to the clean air outlet 110 provided in the rear of the surface cleaning unit 106.

Referring to FIG. 1, a handle 130 is provided toward the top of the up flow conduit 114 to allow a user to manipulate the surface cleaning head 104. In the illustrated example, the up flow conduit 114 extends along an upper axis 132 and is moveably mounted to the surface cleaning head 104. In the illustrated example, the up flow conduit 114 is pivotally mounted to the surface cleaning head 104 via a pivot joint 134. The pivot joint may be any suitable pivot joint. Alternatively, or in addition to being pivotally coupled to the surface cleaning head, the up flow conduit 114 can also be rotatably mounted to the surface cleaning head 104. It will be appreciated that the surface cleaning head 104 and conduit 114 may be of any suitable design and the air flow path to the surface cleaning unit 106 may be of any design/configuration.

Figure 3:
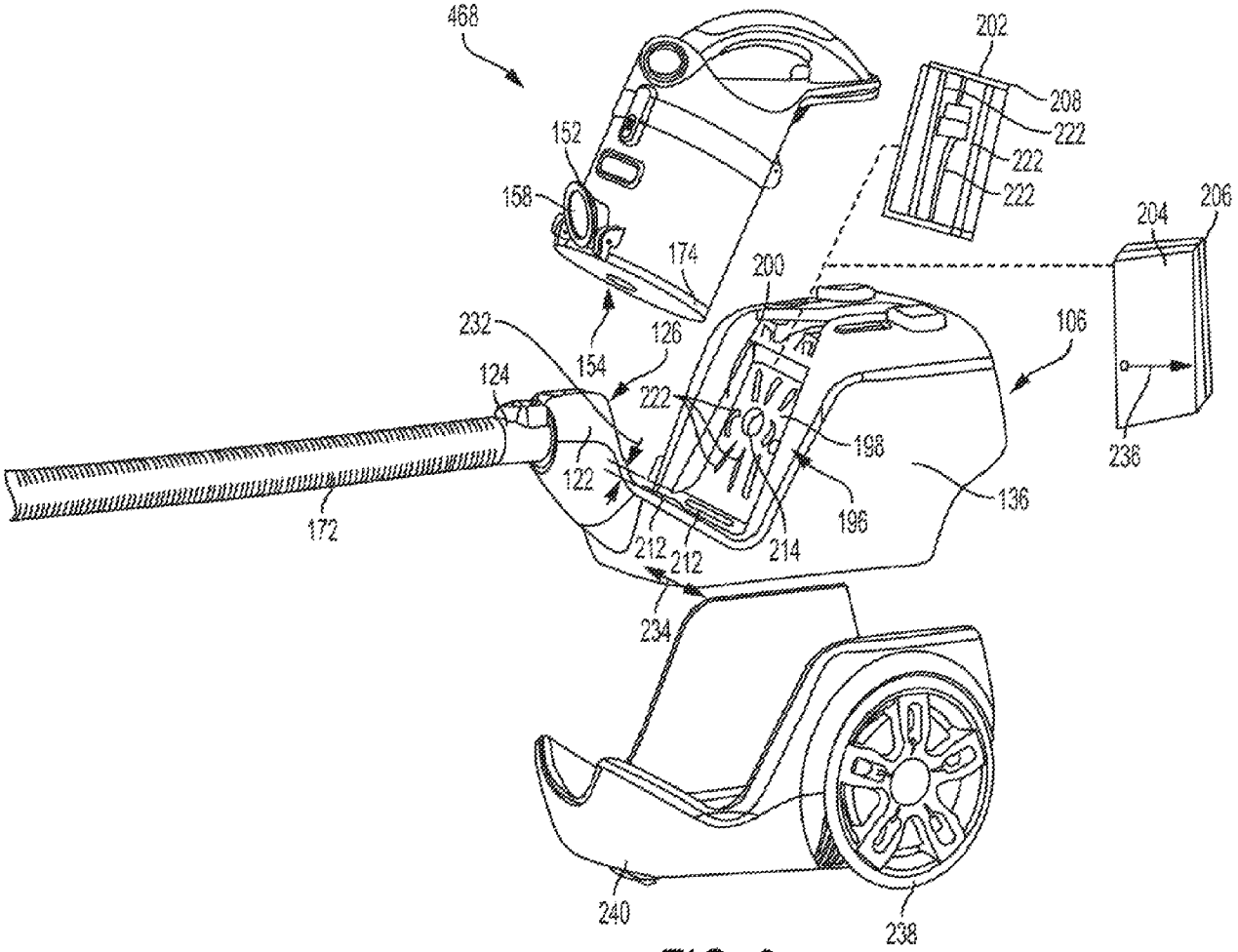
FIG. 3 is a partially exploded perspective view of a portion of the surface cleaning apparatus of FIG. 1.

Referring to FIGS. 3 and 6, in the illustrated example, the surface cleaning unit 106 has a main body 136 that includes the suction motor 116, in a motor housing 138, and the air treatment member in the form of a cyclone bin assembly 118 is mounted on the main body 136. Referring to FIG. 1, the cyclone bin assembly includes a cyclone chamber 140 and a dirt collection chamber 142.

The following is a description of a cyclone construction that may be used by itself in any surface cleaning apparatus or in any combination or sub-combination with any other feature or features disclosed herein.

Figure 7:
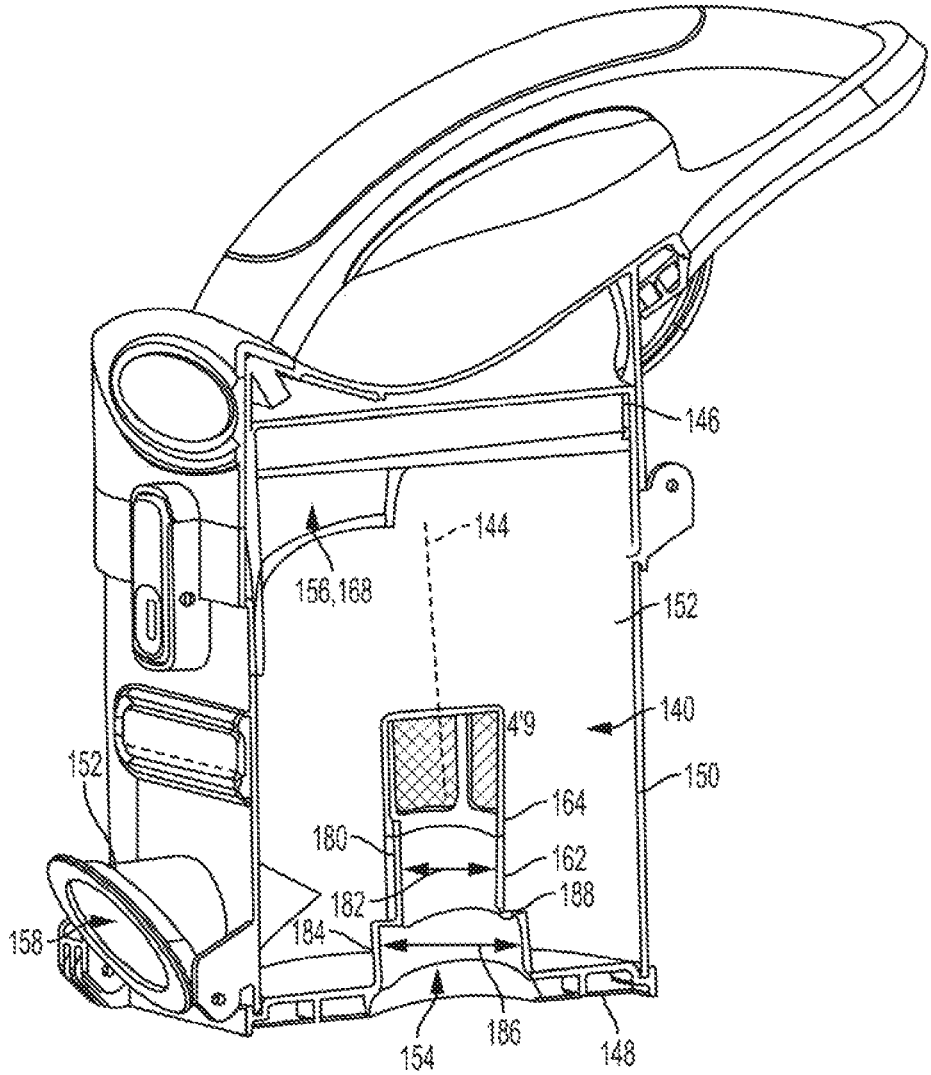
FIG. 7 is a section view of the cyclone bin assembly of FIG. 4, taken along line 7-7.

Referring to FIG. 7, in the illustrated embodiment the cyclone chamber 140 extends along a cyclone axis 144 and includes a first end wall 146, a second end wall 148 axially spaced apart from the first end wall 146 and a generally cylindrical sidewall 150 extending between the first and second end walls 146 and 148. The cyclone chamber 140 has an interior 152 and a cyclone chamber cross-sectional area that is measured in a plane that is generally orthogonal to the cyclone axis 144. Optionally, some or all of the cyclone walls can coincide with portions of walls surrounding the dirt collection chamber 142 and/or may form portions of the outer surface of surface cleaning unit 106. Alternatively, in some examples some or all of the cyclone walls can be distinct from other portions of the surface cleaning unit.

In the illustrated embodiment, the cyclone chamber 140 includes a cyclone air inlet 152 in fluid communication with a cyclone air outlet 154. The cyclone chamber also includes at least one dirt outlet 156, through which dirt and debris that is separated from the air flow can exit the cyclone chamber 140. While it is preferred that most or all of the dirt exit the cyclone chamber via the dirt outlet, some dirt may settle on the bottom end wall 148 of the cyclone chamber 140 and/or may be carried with the air exiting the cyclone chamber via the air outlet 154.

Preferably the cyclone air inlet 152 is located toward one end of the cyclone chamber (the lower end in the example illustrated) and may be positioned adjacent the corresponding cyclone chamber end wall 148. Alternatively, the cyclone air inlet may be provided at another location within the cyclone chamber.

Referring also to FIG. 3, in the illustrated embodiment the air inlet 152 includes an upstream or inlet end 158, which may be coupled to the hose coupling member 122, and a downstream end 160 (FIG. 6) that is spaced apart from the upstream end 158. In the illustrated configuration, the cyclone bin assembly 118 can be removed from the surface cleaning unit 106 (FIGS. 3 and 5), for example, for cleaning or emptying, while the hose 112 remains connected to the hose coupling member 122 and with the surface cleaning unit 106. This may allow a user to remove the cyclone bin assembly 118 without having to detach or decouple the hose 112.

Referring to FIG. 7, air can exit the cyclone chamber via the air outlet 154. Optionally, the cyclone air outlet 154 may be positioned in one of the cyclone chamber end walls, and in the example illustrated is positioned in the end wall 148, at the same end of the cyclone chamber 140 as the air inlet 152. In this configuration, air can enter and exit at the bottom of the cyclone chamber 140.

In the illustrated example, the cyclone air outlet 148 includes a conduit in the form of a vortex finder 162 that extends into the interior 152 of the cyclone chamber 140. In the example illustrated, the cyclone axis 144 is aligned with the orientation of the vortex finder 162. And the air outlet is generally circular in cross-sectional shape.

In the illustrated example, a screen 164 is attached to the upstream end of the vortex finder 162 to help prevent fluff, lint and other debris from exiting via the air outlet 154. Referring to FIG. 6, in the illustrated example the screen 164 is generally cylindrical, but may be of any suitable shape, including for example frusto-conical, in other embodiments. Optionally, the screen 164 can be removable from the vortex finder 162.

When combined with any other embodiment, the cyclone bin assembly may be of any particular design and may use any number of cyclone chambers and dirt collection chambers. The following is a description of exemplified features of a cyclone bin assembly any of which may be used either individually or in any combination or sub-combination with any other feature disclosed herein.

Figure 8:
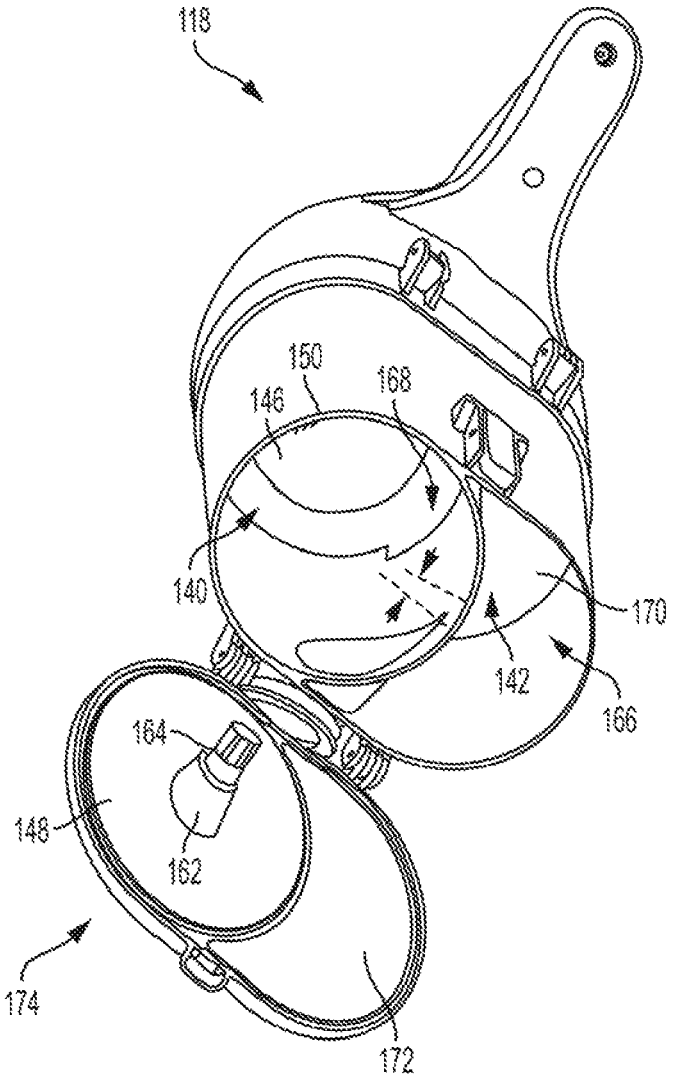
FIG. 8 is a bottom perspective view of the cyclone bin assembly of FIG. 4 with a bottom door open.

Optionally, the cyclone chamber 140 may be in communication with the dirt collection chamber 142 by any suitable means, and in the example illustrated includes a dirt outlet 156. Preferably, as exemplified, the dirt collection chamber 142 is exterior to cyclone chamber 140, and preferably has a sidewall 166 that partially laterally surrounds the cyclone chamber 140. At least partially nesting the cyclone chamber 140 within the dirt collection chamber 142 may help reduce the overall size of the cyclone bin assembly 118. Referring to FIG. 8, in the illustrated embodiment the cyclone chamber sidewall 150 is coincident with the dirt collection chamber sidewall 166 for approximately half its circumference. It will be appreciated that the dirt collection chamber 142 may fully surround the cyclone chamber 140.

In the illustrated example, the cyclone dirt outlet 156 is provided in the form of a slot 168 bounded by the cyclone sidewall 150 and the upper cyclone end wall 146, and is located toward the upper end of the cyclone chamber 140.

Optionally, the slot 168 may extend around the entire perimeter of the cyclone chamber (forming a generally continuous annular gap) or may extend around only a portion of the cyclone chamber perimeter, as illustrated.

Figure 4:
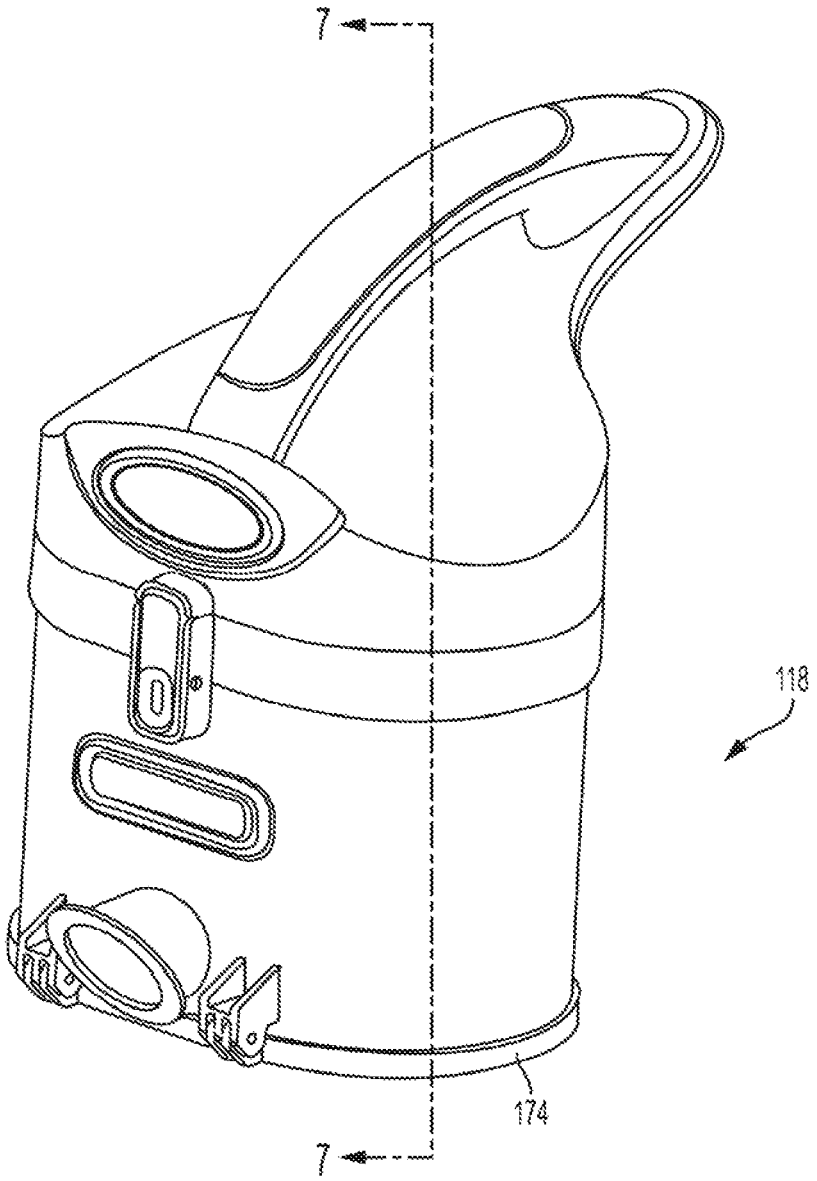
FIG. 4 is a perspective view of an example of a cyclone bin assembly.

To help facilitate emptying the dirt collection chamber, one of or both of the end walls 170 and 172 of the dirt collection chamber may be openable. Similarly, one or both of the cyclone chamber end walls 146 and 148 may be openable to allow a user to empty debris from the cyclone chamber 140. In the illustrated example, the upper dirt chamber end wall 170 is integral with the upper cyclone end wall 146 and the lower dirt collection chamber end wall 172 is integral with, and openable with, the lower cyclone chamber end wall 148 and both form part of the openable bottom door 174. The door 174 is moveable between a closed position (FIG. 4) and an open position (FIG. 8). When the door 174 is open, both the cyclone chamber 140 and the dirt collection chamber 142 can be emptied concurrently.

Optionally, the cyclone bin assembly 118 can be detachable from the main body 136. Providing a detachable cyclone bin assembly 118 may allow a user to carry the cyclone bin assembly 118 to a garbage can for emptying, without needing to carry or move the rest of the surface cleaning apparatus. Preferably, as exemplified in FIG. 5, the cyclone bin assembly 118 is removable as a closed module, which may help prevent dirt and debris from spilling out of the cyclone bin assembly 118 during transport.

Preferably, the cyclone bin assembly 118 can be separated from the motor housing while the surface cleaning unit 106 is mounted on the chassis portion 102 and also when the surface cleaning unit 106 is separated from the chassis portion 102 (FIG. 3). Accordingly, the cyclone bin assembly 118 is preferably positioned on an upper portion of the surface cleaning unit 106 and in the example illustrated is mounted on a platform portion 176 of the main body 136 (FIG. 5) provided forwardly of the suction motor 116.

The cyclone bin assembly 118 is preferably configured so that seating the cyclone bin assembly 118 on the platform portion 176 will position the cyclone bin assembly 118 within the air flow path between the dirty air inlet 108 and the clean air outlet 110.

In the illustrated example, mounting the cyclone bin assembly 118 on the platform establishes a connection between the hose coupling 122 and the cyclone air inlet 152, and between the cyclone air outlet 148 and an air inlet 178 the main body 136.

Referring to FIG. 7, in the illustrated example the vortex finder 162 is provided in the form of a conduit that is integrally formed with the cyclone chamber and has an upper portion 180 that has a first diameter 182 and a wider, lower portion 184 with a larger, second diameter 186. A generally laterally extending shoulder surface 188 extends between the upper and lower portions 180 and 184.

Figure 5:
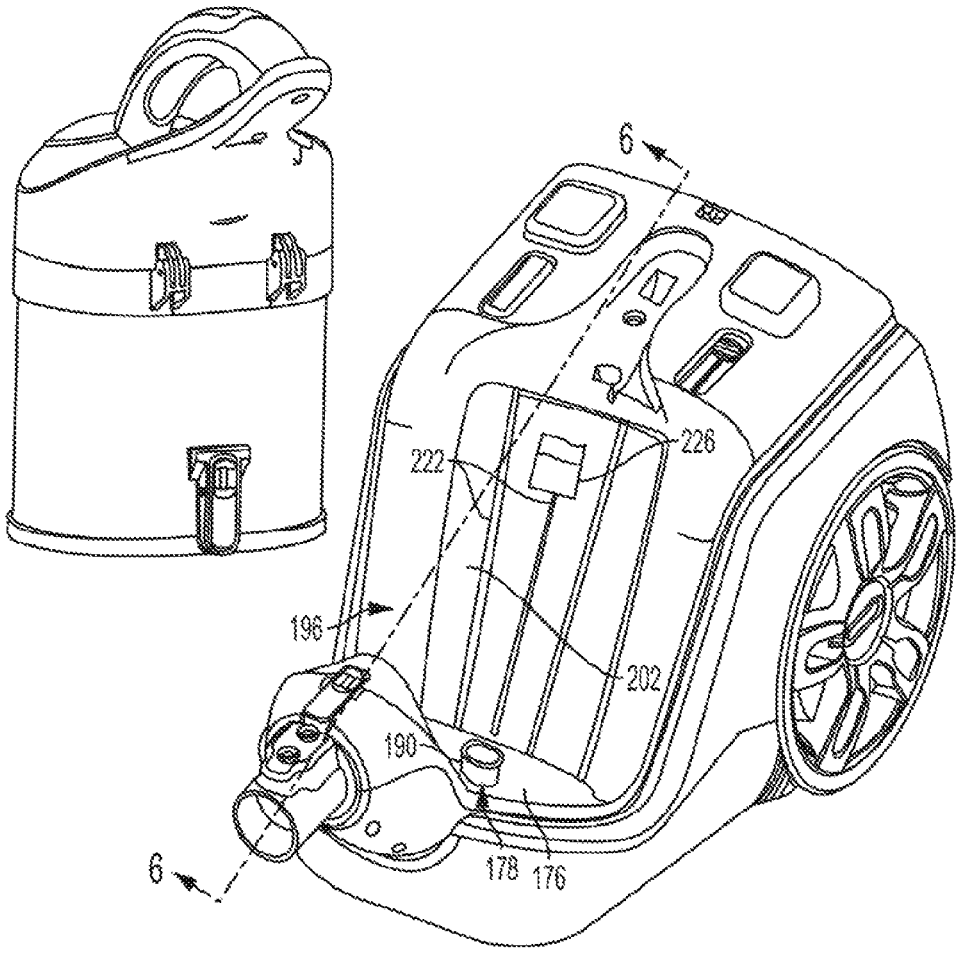
FIG. 5 is a partially exploded perspective view of a portion of the surface cleaning apparatus of FIG. 1.

Referring also to FIGS. 6 and 5, the lower portion 184 of the vortex finder 162 is sized to accommodate a mounting post 190 that is provided on the main body 136. In the illustrated example, the mounting post 190 is a hollow air flow conduit that extends upwardly from a platform portion 176 of the main body 136. In this configuration the mounting post 190 provides the main body air inlet 178 and forms part of the air flow path. Inserting the mounting post 190 into the lower portion 184 of the vortex finder 162 can help align and orient the cyclone bin assembly 118 when it is placed on the main body 136 and can also establish air flow communication between the cyclone chamber air outlet 148, the main body air inlet 178.

Referring to FIG. 6, in the illustrated example the mounting post 190 includes an upstream end 192 that is configured to nest within the lower portion 184 of the vortex finder 162, and a downstream end 194 that is in communication with the internal air flow conduit 128.

Optionally, the surface cleaning unit may include one or more filters positioned in the air flow path between the cyclone chamber and the suction motor. The filters may be configured to filter out fine dust and debris that remains entrain with the air leaving the cyclone chamber. The filters may be contained in a filter chamber that is provided in the surface cleaning unit. Preferably, the filter chamber can be accessed by a user, which may help facilitate inspection and/or replacement of the filters positioned within the filter chamber. Optionally, more than one filter member may be contained within a single filter chamber.

The following is a description of a pre-motor filter housing that may be used by itself in any surface cleaning apparatus or in any combination or sub-combination with any other feature or features disclosed herein.

Referring to FIG. 5, in the illustrated embodiment, the main body 136 of the surface cleaning unit 106 includes a pre-motor filter chamber 196 that is positioned in the air flow path between the cyclone chamber 140 and the suction motor 116 (see also FIG. 6). The pre-motor filter chamber 196 includes a rear wall 198, a sidewall 200 extending from the rear wall 198 and front wall 202 opposite the rear wall 198 which together cooperate to surround a chamber interior. Referring to FIG. 5, in the illustrated embodiment, removing the cyclone bin assembly 118 reveals the front wall 202 of the pre-motor filter chamber 196.

Preferably, one or more filters can be provided in the pre-motor filter chamber 196 to filter the air exiting the cyclone bin assembly 118 before it reaches the motor 116. Referring to FIG. 6, in the illustrated example, the pre-motor filters include a foam filter 204 and a downstream felt layer 206 positioned within the pre-motor filter chamber 196. Preferably, the filters 204 and 206 and are removable to allow a user to clean and/or replace them when they are dirty.

Preferably, one or more of the walls of the pre-motor filter chamber 196 are openable, removable or otherwise reconfigurable to allow a user to access the interior of the pre-motor filter chamber. In the illustrated example, the front wall 202 is removable and can be moved from a closed position, in which it seals enclosing the pre-motor filter chamber (FIG. 5) and an open position in which a user can access the interior of the pre-motor filter chamber (FIG. 3).

The front wall 202 can be attached to the sidewall 200 using any suitable mechanism, such as latches, pins and other fasteners. In the illustrated example, the front wall 202 connects to the sidewall 200 via a friction fit. In this configuration, the front wall 202 can be removed and re-connected to the sidewall 200 without having to release a latch or other type of retaining fastener. This may help facilitate one-handed removal of the front wall 202.

Optionally, a gasket 208 can be provided around the perimeter of the front wall 202. The gasket 208 may help seal the pre-motor filter chamber 196 and/or may help facilitate the friction fit between the front wall 202 and the sidewall 200.

Figure 2:
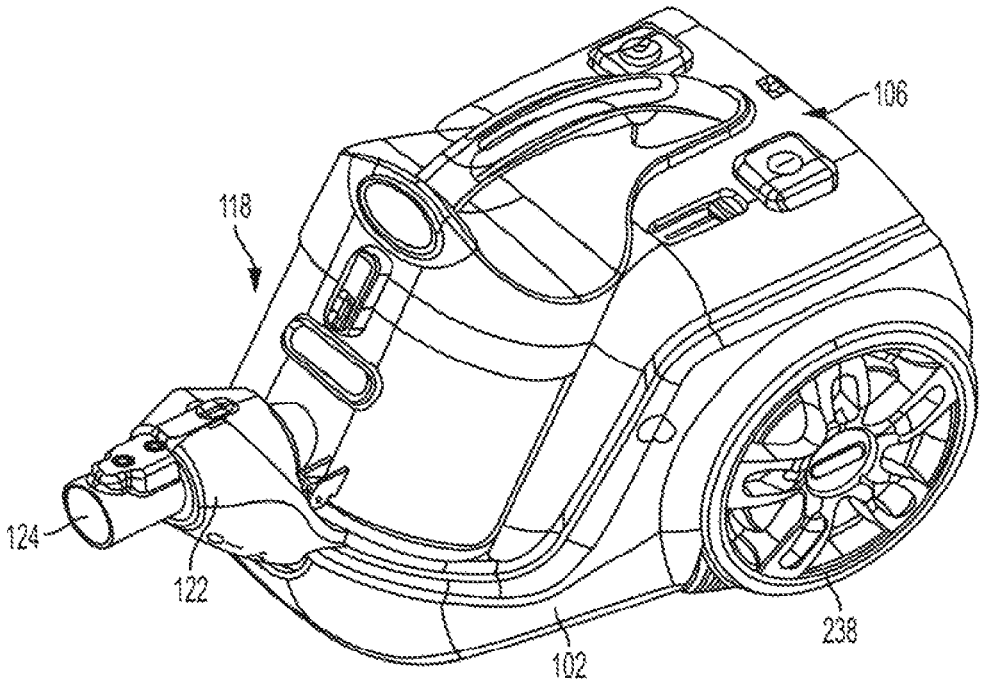
FIG. 2 is a perspective view of a portion of the surface cleaning apparatus of FIG. 1.

Referring to FIGS. 2 and 6, in the illustrated example, when the cyclone bin assembly 118 is mounted on the main body 136 the pre-motor filter chamber 196 is disposed longitudinally between the cyclone bin assembly 118 and the suction motor 116 and the cyclone bin assembly 118 is positioned in front of at least a portion of the openable front wall 202 of the pre-motor filter chamber 196. In this configuration the pre-motor filter chamber 196 is substantially blocked/covered when the cyclone bin assembly 118 is mounted on the main body 136, and in the example illustrated the front wall 202 abuts a portion of the sidewall 150 of the cyclone bin assembly 118. Also, in this configuration the pre-motor filter chamber 196 overlies one end of the suction motor 116 such that a suction motor axis 210 (about which the rotor rotates) intersects the pre-motor filter chamber 196, and specifically, in the illustrated example intersects the front wall 202, the rear wall 198 and both of the filters 204 and 206 disposed within the pre-motor filter chamber 196. The motor axis 210 will also intersect the cyclone bin assembly 118 when it is mounted to the main body 136 and covers the front wall 202.

In the illustrated example, the front wall 202 is smaller than the cyclone bin assembly 118, and is completely covered when the cyclone bin assembly 118 is mounted on the main body 136. This may help protect the pre-motor filter chamber 196 and may obscure it from view when the surface cleaning apparatus 100 is in normal use. This may also help prevent a user from accessing the pre-motor filter chamber 196 while the surface cleaning apparatus is in use, and/or may help limit accidental or unwanted opening of the pre-motor filter chamber 196. In this configuration, the front wall 202 is exposed and is accessible only when the cyclone bin assembly 118 is removed from the main body 136.

Referring to FIGS. 3 and 6, the pre-motor filter chamber includes a chamber air inlet 212 for supplying air to the pre-motor filter chamber 196 upstream of the filters 204 and 206, and a chamber air outlet 214 downstream from the filters 204 and 206 for withdrawing air from the pre-motor filter chamber 196.

In the illustrated example, the foam filter 204 has an upstream side 216 (FIG. 6) and an opposite downstream side 218 (referenced to the direction of air flow through the filter). In the illustrated example, the upstream side 218 of the foam filter faces outward (i.e. away from the main body 136 and generally toward the cyclone bin assembly 118) and is visible when the front wall 202 is removed. In this configuration, a user may be able to visually inspect the upstream side 216 of the foam filter 204 without having to remove the foam filter 204 from the pre-motor filter chamber 196.

When the front wall 202 is attached to the sidewall 200 to enclose the pre-motor filter chamber 196 an open headspace 220 or header is provided between the front wall 202 and the upstream side 216 of the foam filter 204 and functions as an upstream air plenum. Providing the upstream plenum 220 allows incoming air to flow across the upstream side 216 of the filter 204. To help maintain the desired spacing between the upstream side 216 of the filter 204 and the front wall 202 ribs 222 are provided on the inner surface of the front wall 202 (FIG. 3). The ribs 222 extend from the front wall and will bear against the upstream side 216 of the foam filter 204 to help maintain the desired spacing between the front wall 202 and the foam filter 204. The ribs 222 are spaced apart from each other to allow air to flow between them, within the upstream plenum 220, and across the upstream face 216 of the foam filter 204.

A similar open headspace 224 or header is provided downstream of the filters 204 and 206 between the felt filter 206 and the rear wall 198 and provides a downstream air plenum. Providing a downstream plenum allows air exiting the filters 204 and 206 to flow laterally across the downstream side of filter 206 and toward the pre-motor filter chamber air outlet 214. In use, air exits the cyclone chamber 140 via the air outlet 154 and flows into upstream plenum 220, through filters 204 and 206 into downstream plenum 224 and into the air outlet 214 of the pre-motor filter chamber 196.

In the illustrated example, the rear wall 198 also includes a plurality of supporting ribs 222 (FIG. 3) that project from the rear wall 198 into the chamber interior. The ribs 222 are configured to contact the downstream side of the filters (in this example felt filter 206) in the pre-motor filter chamber 196 and to hold it apart from the rear wall 198, thereby help to maintaining the downstream plenum. The ribs 222 are spaced apart from each other to allow air to flow between them, within the plenum, and toward the suction motor air outlet. Optionally, some or all of the support ribs 222 in the pre-motor filter chamber 196 (on either the front or rear walls 202 and 198, or both) may be configured to help guide or direct the air flowing through the plenums.

Optionally, the one or more of the walls of the pre-motor filter chamber can be at least partially transparent so that a user can visually inspect the condition of the filters to determine if they require cleaning or replacement without having to remove the cyclone bin assembly. In the illustrated example, the removable front wall 202 is transparent. This allows a user to visually inspect substantially the entire upstream face 216 of the foam filter 204 without having to open the front wall 202. This may also facilitate visual inspection of the foam filter 204 each time the cyclone bin assembly 118 is removed or re-attached because the front wall 202 is positioned behind the cyclone bin assembly 118. This may help facilitate more frequent visual inspection of the foam filter 204 than would be achieved if the front wall 202 were opaque or if the pre-motor filter chamber 196 was located at a different location on the main body 136.

Referring to FIG. 5, in the illustrated example the front wall 202 includes a handle portion in the form of a recess 226 that is graspable by a user. Providing a handle portion 226 may help facilitate removal and/or handling of the front wall 202. In the illustrated example, the handle portion 226 is covered by the cyclone bin assembly 118 when it is mounted on the main body 136.

Preferably, the air inlet 212 of the pre-motor filter chamber 196 is positioned such that it is in communication with the upstream plenum 220, and the pre-motor filter chamber air outlet 214 is in communication with the downstream plenum 224. Referring to FIG. 3, in the illustrated embodiment, the air outlet 214 is provided in the rear wall 198 and is in communication with the suction motor inlet 228 (FIG. 6). The pre-motor filter chamber air inlet 212 is in communication with the upstream plenum and is provided in the form of a generally elongate inlet slot in the chamber sidewall 200. In the illustrated example, the inlet slot 212 is provided in a lower portion of the sidewall 200 and is in communication with cyclone air outlet 154 via the internal conduit 128. In this configuration, air exiting the cyclone chamber 140 flows generally downwardly through the vortex finder 162 and the main body air inlet 178, generally rearwardly through the internal conduit 128 and then generally upwardly through the inlet slot 212 and into the upstream plenum 220. The air can then flow generally rearwardly through the filters 204 and 206 and into the suction motor 116. In this configuration, air travelling through the inlet slot 212 travels generally upwardly in a direction that is generally parallel to a plane containing the pre-motor filter chamber front wall 202 and is generally orthogonal to the motor axis 210. In the illustrated embodiment, the inlet slot 212 is disposed below a plane 230 that contains the bottom wall 148 of the cyclone chamber 140 and the cyclone air outlet 154.

Referring the FIG. 3, the inlet slot has a slot width 232 and a slot length 234. Optionally, the slot length 234 can be selected such that it is at between about 30% and about 100% of the width 236 of the filters (i.e. the foam filter width 236) contained in the pre-motor filter chamber 196. In the illustrated example, the slot width is about 1 cm and the slot length is about 15 cm, which as illustrated, is about 94% of the 16 cm width 236 of the foam filter. Providing a slit with a length 234 that is relatively long may help distribute the incoming air flow across the width 236 of the upstream face 216 of the foam filter 204.

The inlet slot 212 may have any suitable configuration and may include generally sharp corners (i.e. is generally rectangular), or alternatively may have rounded corners (i.e. is generally oval-like). The inlet slot 212 also has an inlet flow area (measured in a plane that is generally orthogonal to the direction of air flow through the inlet slot). Similarly, the air outlet 214 has an outlet flow area (measured in a plane that is generally orthogonal to the direction of air flow through the outlet slot). Optionally, the inlet flow area and on the outlet flow area may be between about 5% and about 30% of the area of the upstream face 216 of the foam filter 204. Optionally, the inlet flow area may be about 30-130% of the outlet flow area.

In the illustrated example, the area of the upstream face 216 of the foam filter 204 is relatively large. Providing a relatively large filter surface area may help reduce back pressure in the air flow path and/or may help facilitate air flow through the foam filter 204. In the illustrated example, the area of the upstream face of the foam filter is between about 300 $cm^2$ and 400 $cm^2$ and is greater than the cyclone chamber cross sectional area.

In one aspect of the teachings described herein, which may be used in combination with any one or more other aspects, the surface cleaning unit may be operable in a variety different functional configurations or operating modes. The versatility of operating in different operating modes may be achieved by permitting the surface cleaning unit to be detachable from the chassis portion. Alternatively, or in addition, further versatility may be achieved by permitting portions of the vacuum cleaner to be detachable from each other at a plurality of locations in the chassis portion, and re-connectable to each other in a variety of combinations and configurations.

In the example illustrated, mounting the surface cleaning unit 106 on the chassis portion 102 allows the chassis portion 102 to carry the weight of the surface cleaning unit 106 and to, e.g., rollingly support the weight using rear wheels 238 and front wheel 240. With the surface cleaning unit 106 attached, the vacuum cleaner 100 may be operated like a traditional canister-style vacuum cleaner.

Alternatively, in some cleaning situations the user may preferably detach the surface cleaning unit 106 (FIG. 3) from the chassis portion 102 and choose to carry the surface cleaning unit 106 (e.g. by hand or by a strap) separately from the chassis portion, while still using the up flow conduit 114 to drivingly maneuver the surface cleaning head 104. When the surface cleaning unit 106 is detached, a user may more easily maneuver the surface cleaning head 104 and the cleaning unit 106 round obstacles, like furniture and stairs.

To enable the vacuum suction generated by the surface cleaning unit 106 to reach the surface cleaning head 104 when the surface cleaning unit 106 is detached from the chassis 102, the airflow connection between the surface cleaning head 104 and the cleaning unit 106 is maintained by the flexible hose 112. The hose 112 is preferably attached to the surface cleaning unit 106 and not the chassis 102 so as to allow a user to detach the surface cleaning unit 106 and maintain a flow connection between the portable surface cleaning unit 106 and the surface cleaning head 104 without having to reconfigure or reconnect any portions of the airflow conduit.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface treatment apparatus comprising:

an air flow path extending from a dirty air inlet to a clean air outlet;

a main body comprising a front end, a rear end, and a suction motor provided in the air flow path;

a cyclone bin assembly provided in the air flow path, the cyclone bin assembly being removably mountable to the main body;

a pre-motor filter chamber including:

a recessed region defined in the main body, the recessed region having a rear wall and a sidewall extending from the rear wall; and an openable front wall opposite the rear wall, the openable front wall enclosing the recessed region such that, when the cyclone bin assembly is removed from the main body, the pre-motor filter chamber remains enclosed; and wherein, when the cyclone bin assembly is mounted on the main body, the pre-motor filter chamber is disposed longitudinally between the cyclone bin assembly and the suction motor and the cyclone bin assembly is positioned in front of at least a portion of the openable front wall of the pre-motor filter chamber.

2. The surface treatment apparatus of claim 1, wherein, when the cyclone bin assembly is mounted on the main body, the cyclone bin assembly covers the entire front wall.

3. The surface treatment apparatus of claim 1, wherein at least a portion of the front wall is transparent.

4. The surface treatment apparatus of claim 3, wherein, when a filter is positioned in the pre-motor filter chamber, an upstream surface of the filter faces and is spaced apart from the front wall.

5. The surface treatment apparatus of claim 1, wherein the pre-motor filter chamber comprises a chamber air inlet in communication with the cyclone bin assembly and disposed on the sidewall.

6. The surface treatment apparatus of claim 5, wherein the chamber air inlet comprises an elongate slit in the sidewall, wherein the filter has a width in a transverse direction that is generally orthogonal the longitudinal direction and the slit has a width in the transverse direction that is between about 30% and about 100% of the width of the filter.

7. The surface treatment apparatus of claim 5, wherein the pre-motor filter chamber comprises a chamber air outlet disposed on the rear wall and in communication with the suction motor.

8. The surface treatment apparatus of claim 1, wherein the suction motor extends along a motor axis, and the motor axis intersects both the front wall and the rear wall.

9. The surface treatment apparatus of claim 8, wherein when the cyclone bin assembly is mounted on the main body the motor axis intersects the cyclone bin assembly.

10. The surface treatment apparatus of claim 1, wherein the front wall comprises an inner surface and at least one rib projecting from the inner surface, and, when the front wall is enclosing the pre-motor filter chamber the at least one rib bears against a filter positioned in the pre-motor filter chamber.

11. The surface treatment apparatus of claim 1, wherein the cyclone chamber has an axial cross-section area and a filter cross-sectional area in an air flow direction that is equal to or greater than the cyclone chamber cross-sectional area.

12. The surface treatment apparatus of claim 1, wherein the front wall comprises a handle portion.

13. The surface treatment apparatus of claim 1, wherein the front wall sealingly connects to the sidewall via a friction fit and is detachable from the sidewall in the absence of releasing a retaining fastener.

14. The surface treatment apparatus of claim 1, wherein the cyclone bin assembly comprises a lower end wall comprising a bin assembly air outlet, an opposing upper end wall and an exterior bin sidewall extending therebetween, and wherein when the cyclone bin assembly is mounted on the main body the front wall abuts a first portion of the bin sidewall.

15. The surface treatment apparatus of claim 14, wherein the cyclone bin assembly further comprises a bin air inlet disposed in a second portion of the bin sidewall, the second portion of the bin sidewall being longitudinally opposite the first portion of the bin sidewall.

16. The surface treatment apparatus of claim 1, wherein the main body comprises a chassis comprising at least two wheels and a cleaning unit detachably mounted to the chassis, the cleaning unit comprising the suction motor, the pre-motor filter chamber and the cyclone bin assembly and being operable to clean a surface while detached from the chassis.

* * * * *